US005433384A

United States Patent [19]

Chan et al.

[11] Patent Number: 5,433,384

[45] Date of Patent: Jul. 18, 1995

[54] PUSH BUTTON CONTROLLED MULTIFUNCTION SHOWER HEAD

[75] Inventors: Raymond W. M. Chan, Vancouver, Canada; Joseph E. Ford, Cary; Ronald O. Hilger, Elmhurst, both of Ill.

[73] Assignee: Jing Mei Industrial Limited, New Zealand

[21] Appl. No.: 265,424

[22] Filed: Jun. 24, 1994

[51] Int. Cl.[6] ..... B05B 1/16; B05B 1/08

[52] U.S. Cl. ..... 239/449; 239/239; 239/381

[58] Field of Search ..... 239/443, 446–449, 239/381, 383

[56] References Cited

U.S. PATENT DOCUMENTS 3,963,179 6/1976 Tomaro ..... 239/449

4,165,837 8/1979 Rundzaitis ..... 239/449

4,398,669 8/1983 Fienhold ..... 239/449

FOREIGN PATENT DOCUMENTS 461088 12/1991 European Pat. Off. ..... 239/447

*Primary Examiner*—Karen B. Merritt

*Attorney, Agent, or Firm*—Laff, Whitesel, Conte & Saret

[57] ABSTRACT

A push button controlled multifunction shower head. The push button moves a pawl attached to spring biased slide, the pawl bearing against a ratchet wheel which is rotated through a predetermined arcuate step responsive to each push button operation. The ratchet wheel moves a shutter which directs water into a selected one of several races, each race being individually associated with a spray pattern. The shower head may be built into a hand held housing wherein the handle may be held and the push button may be operated by one hand.

15 Claims, 4 Drawing Sheets

PUSH BUTTON CONTROLLED MULTIFUNCTION SHOWER HEAD

This invention relates to muitifunction shower heads and more particularly to such shower heads wherein any one of a plurality of spray patterns may be selected in a simple and easy manner by the push of a button.

Multifunction shower heads are able to deliver water in any of many different spray patterns, such as a fine spray, a coarse spray, or a pulsating spray. Of course, many other spray patterns may also be provided. These multifunction shower heads may be offered in both wall mounted and hand held models. Therefore, the same internal mechanism should be usable in either model.

The conventional multifunction shower heads generally require the user to turn a selector ring or dial in order to select a desired function. Turning this ring is not too easily performed by a person having soapy hands. On the wall mounted shower heads, the person tends to look at the shower head while he turns the selector ring or dial and, therefore, may get an unexpected spray in the face as the spray pattern changes from, say a narrow and directed stream to a wide pattern spray. A hand held shower head is usually connected to the end of a flexible rubber hose; hence, it is generally necessary to hold the shower head in one hand and to turn a selector ring or dial with the other hand in order to select a shower spray pattern. Since the selector ring or dial is on the side of the hand held shower head which issues the water, it is necessary to either turn off the water every time that the selector ring is turned or reach around to the bottom of the shower head and turn the ring from below the head, which is very awkward.

For these and many other reasons, it would be desirable to provide a shower head having a way to select a shower spray pattern quickly and easily without having to look at a dial. On the hand held model, it is desirable to make a selection by the thumb on the same hand that is holding the shower head, without having to either turn off the welter or risk spraying in an unwanted direction.

Accordingly, an object is to provide a new and improved shower head controlled by a push button multifunction spray pattern selector.

In this connection, an object of the invention is to provide both a wall mounted and a hand held shower head using most of the same piece parts and, in the hand held model, having multifunction spray patterns which may be selected by the thumb of the hand holding the shower head. Here an object is to provide such a shower head which is more resistant to inoperativeness through a liming of parts.

In keeping with an aspect of the invention, these and other objects are accomplished by a shower head having a push button operated pawl and ratchet wheel cam controlled spray pattern selector. On each operation of the push button, a ratchet wheel takes one step. A gear associated with the ratchet wheel rotates through an arc corresponding to the step of the ratchet wheel. Each rotation of this gear turns a shutter plate which switches the water flow from one shower pattern to the next.

A preferred embodiment of the invention is shown in the attached drawings wherein.

Figure 1:
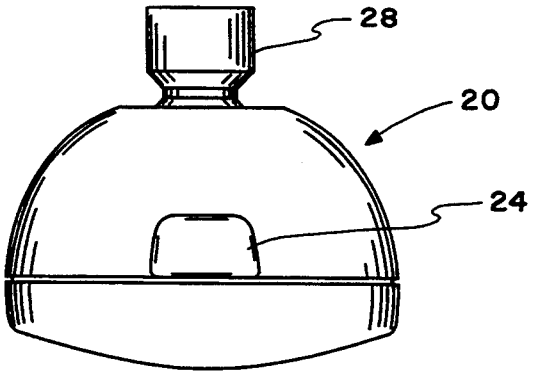
FIG. 1 is a side elevation of a wall mounted model of the inventive shower head.

The exterior housings 20 of the wall mounted (FIG. 1) and 22 of the hand held (FIG. 2) shower heads have a push button 24 extending therefrom. The wall mounted model 20 is installed by turning a coupler 28 onto an overhead plumbing pipe (not shown) projecting from the wall. The hand held model is connected to the plumbing via a rubber hose (not shown) attached to a coupler 30 at the end of the handle 26.

The push button 24 may be located at any convenient position on the shower head; however, these figures show the push button in the position which is judged to be most convenient. In the hand held model (FIG. 2), the push button 24 is located so that it may be operated by the thumb of a hand holding the handle 26. This enables a person to point the shower head in any convenient direction while moving his thumb in order to change the spray pattern.

The same face plate 32 (FIG. 2) may be used on both the wall mounted and hand held shower heads. One spray pattern of water emitting holes form a circular pattern of openings 34 which may issue a fine spray. Another circular pattern of openings 36 may issue a coarse spray. Grouped openings 38*a*–38*c* issue a pulsing spray. Any other suitable pattern of water spray holes may be provided, such as a center opening to emit a steady stream, gusher or other spray pattern of water, for example. The symbols at 42 are internationally adopted symbols which identify the spray pattern which has been selected.

Figure 3A:
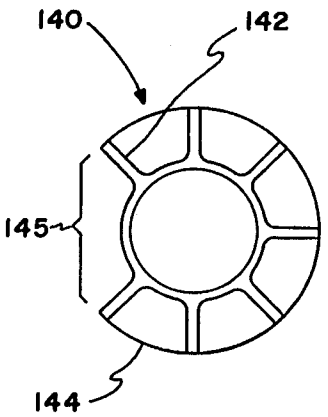
FIG. 3A is a plan view of a propeller or turbine for giving a pulsating spray patter.
Figure 3:
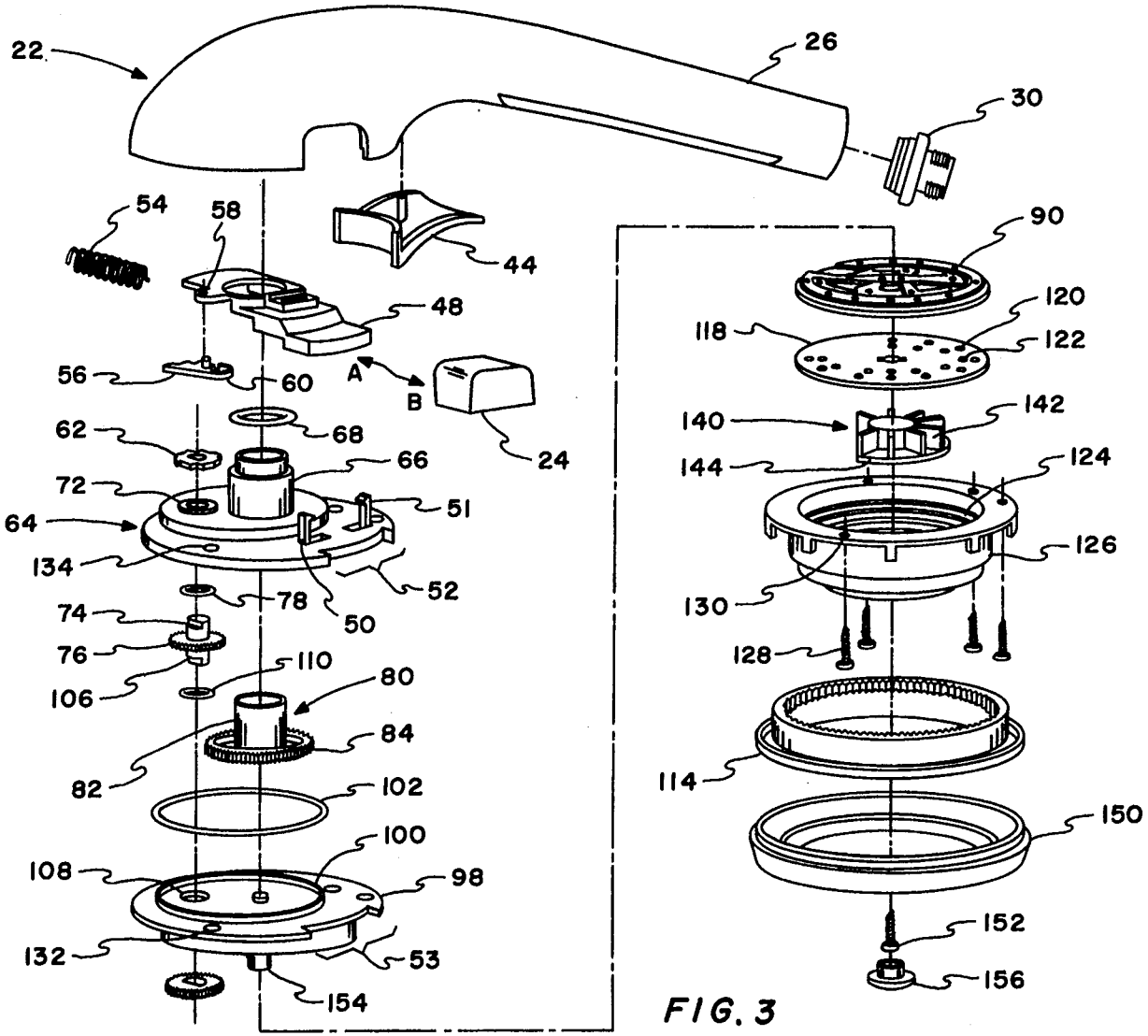
FIG. 3 is an exploded view of the hand held model.
Figure 4:
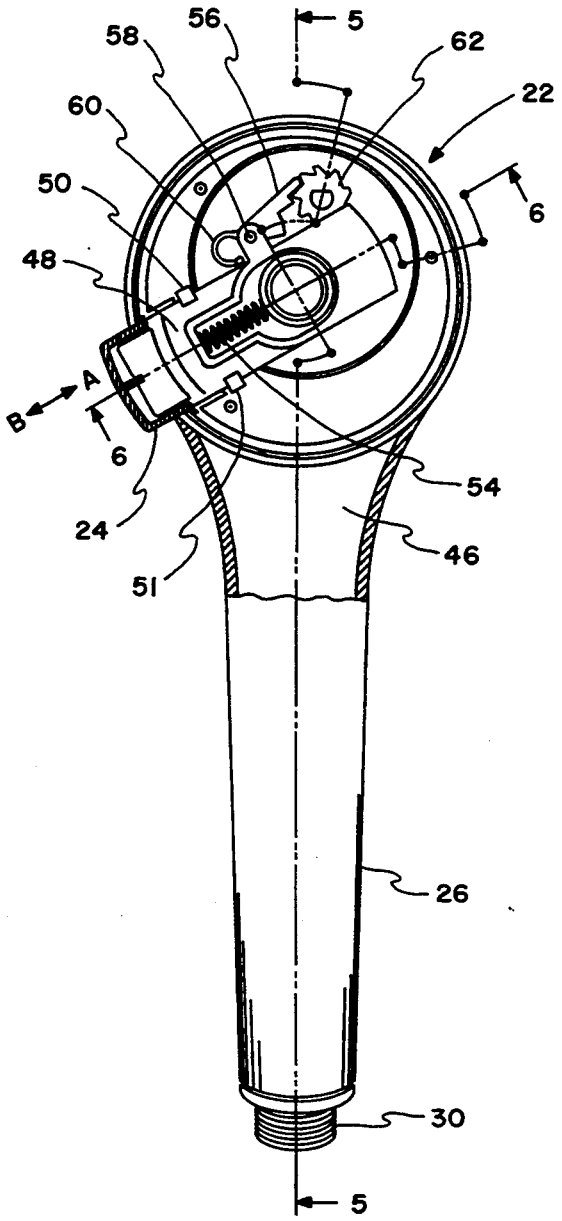
FIG. 4 shows a portion of the hand held shower head with a number of parts removed to show the push button, pawl, and ratchet wheel construction.
Figure 5:
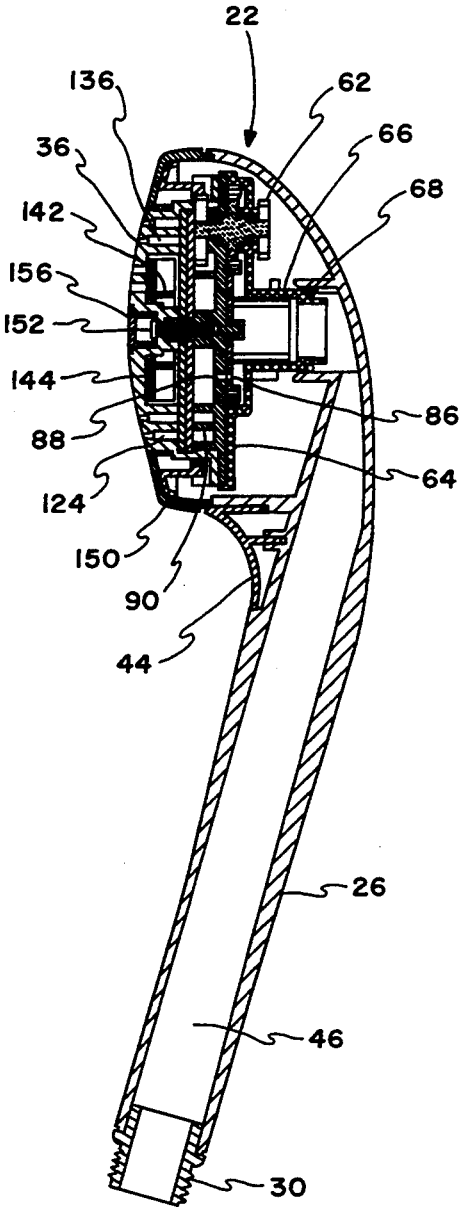
FIG. 5 is a cross section taken along line 5—5 of FIG. 4.
Figure 6:
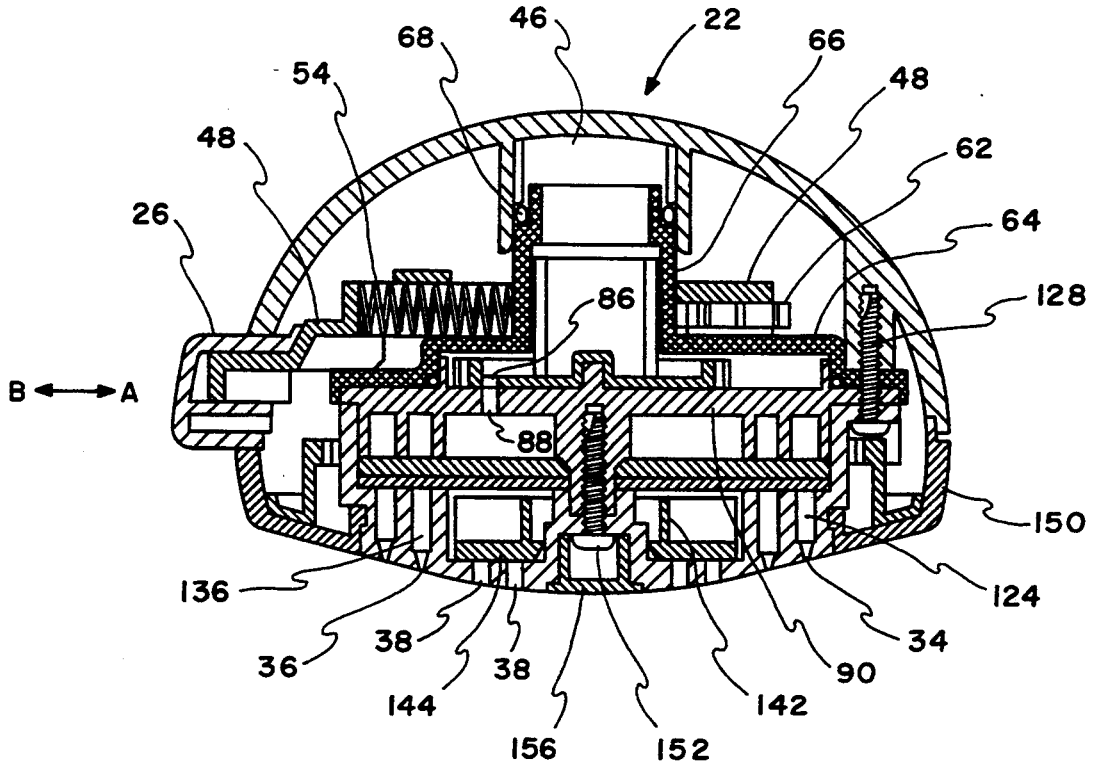
FIG. 6 is a cross section taken along line 6—6 of FIG. 4.

The internal parts of the shower head are shown in the exploded view of FIG. 3, and in other figures. While the parts in FIG. 3 are shown in hand held housing 22, it should be understood that they could also be in the wall mounted housing which is essentially identical to the hand held version except for the device 28 (FIG. 1) that makes a connection with the hose or plumbing pipe.

Figure 7:
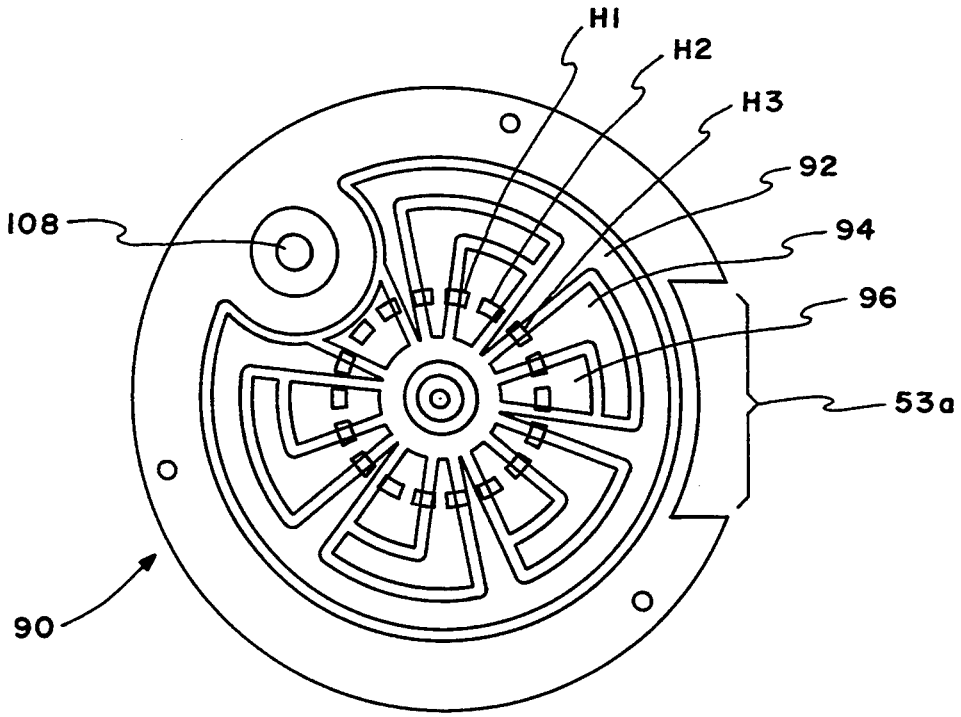
FIG. 7 is a top plan view of a flow chamber.

In FIGS. 3–6, a water passage way 46 leads from the hose coupler 30 through handle 26 to the water emitting part of the shower head. Inside the shower head a recoil spring biased slide 48 is mounted to move back and forth (directions A,B) between normal and off normal positions. The slide plate is slidingly held by guide ways 50 and 51 (FIG. 4) and by cut out openings 52 and 53 (FIGS. 3, 7). A recoil spring 54 urges the slide to a normal or an outwardly extending (direction B) position. When pushed, the push button 24 moves the slide (direction A) to an off normal or an inward position.

An actuator pawl 56 is pivotally attached (FIG. 4) to slide 48 at a pivot point 58. The pawl is a molded plastic part having a leaf spring 60 integrally formed at the back in order to bias the front of the pawl into engagement against a wheel ratchet cam 62. Each time that the push button 24 is pushed, slide 48 moves in direction A to the off normal position. Actuator pawl 56 pushes against a tooth on the ratchet wheel cam 62 to cause it to take one rotary step about an arc determined by the length of the slide 48 excursion. Each time that the push button is released, the recoil spring 54 causes the pawl 56 to return to the normal position. Leaf spring 60 allows the pawl 56 to pass over the apex of next to the pushed tooth and then to drop into and engage the root of the next tooth on the ratchet wheel cam 62.

An inner housing 64 supports the parts. An upstanding collar 66 receives an O-ring 68 that makes a water tight seal between the inner housing 64 and the water channel 46 in handle 26. The inner housing 64 has the integrally formed guides 50 and 51 and a cut out section 52 for guiding and directing slide 48 as it moves back and forth. An opening 72 receives a shaft 74 of a drive gear 76. The ratchet wheel cam 62 fits on the top of shaft 74. Each time that pawl 56 pushes against a tooth of the ratchet wheel cam 62, the drive gear 76 rotates through a particular arc corresponding to the excursion of the ratchet wheel cam. An O-ring 78 makes a water tight seal between the shaft 74 and the inner housing plate 64.

A shutter plate 80 is an integral plastic part having a axle formed by a collar 82 which fits into a corresponding collar 66 of inner housing 64. Collar 66 is, in effect, a bearing for the axle 82. Shutter plate 80 has a peripheral gear 84 which meshes with the drive gear 76. Hence, the shutter plate 80 takes an incremental rotary excursion every time that the push button 24 is turned.

The shutter plate 80 has a hole or holes 86 (FIGS. 5 and 6) therein which aligns with a different channel 92, 94, 96 in diverter plate 90 (FIG. 7) on each step caused by the motion responsive to each push button operation. Depending upon which of the channels 92, 94, 96 of the diverter plate 90 is selected by the stopping position of the shutter plate hole 86, water will flow along a particular diverter plate channel, and out an associated hole H1, H2, or H3, and into a selected race feeding an individually associated pattern of face plate spraying holes 34, 36, 38 (FIG. 2), thereby selecting the spray pattern of water issuing from the head. From FIG. 7, it will be observed that the same channel pattern is repeated five times on diverter plate 90. The shutter plate 80 may have five holes equally spaced around it periphery in order to feed water to an individually associated one of the diverter plate channels which gives a better balance of mechanical forces within the shower head.

A second inner support plate 98 (FIG. 3) forms a means for supporting both the shutter plate 80 and the diverter plate 90. On the upper side of support plate 98 is an upstanding circular wall 100 which receives an O-ring 102 that seals off the water chamber. Support plate 98 has the cut out area 53 which is part of the guide channel in which the push button controlled slide 48 moves. The lower axle 106 on drive gear 76 fits through a hole 108 in the support plate 98. An O-ring 110 fits over axle 106 to make a water tight seal. Mounted on the bottom of shaft 106 is a gear 112 which moves in unison with drive gear 76 and which is coupled to turn an indicator ring 114 for displaying a symbol 42 (FIG. 2) identifying the selected spray pattern.

A elastomeric gasket 118 has a number of holes (such as 120, 122) formed therein. The shutter gear 80 selects a flow channel (really five channels in the repeated patterns) on the diverter plate 90 which leads to a number of the holes 120, 122 in gasket 118. These holes are positioned over a number of races, such as 124, in a lower housing 126. Accordingly, the position of shutter plate 80 determines which of the races is energized with water and, therefore, the spray pattern of water that will issue from the shower head.

A number of thread cutting screws (such as 128) pass through holes such as 130, 132, 134 in order to secure the assembly extending from inner housing 64 through lower housing 126.

Figure 2:
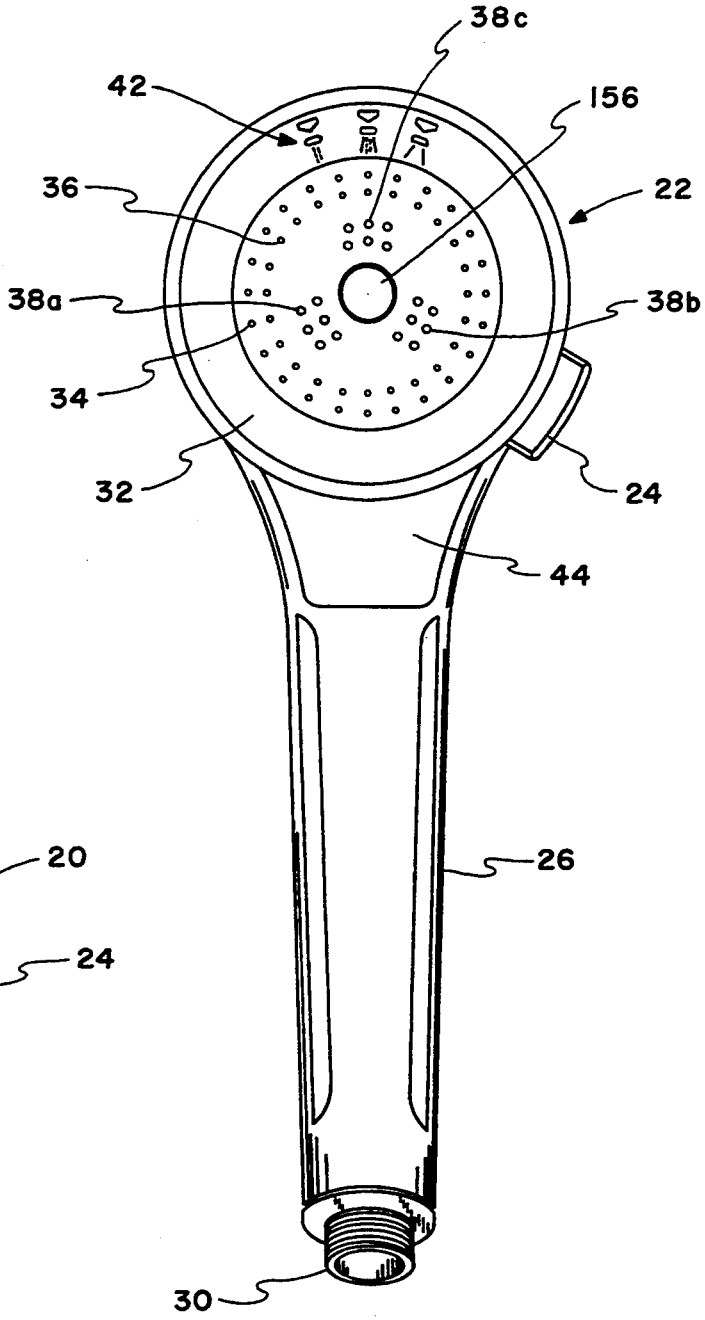
FIG. 2 is a bottom plan view of a hand held model of the inventive shower head.

The individual races 124 in the lower housing 126 are positioned behind individually associated patterns of spray holes 34–40 (FIG. 2). Thus, if the shutter plate 80 (FIG. 3) is positioned over diverter plate 90 to direct water into the first or outer most race 124, water is emitted in a fine spray through holes 34. If the shutter plate 80 is positioned to direct water through the second or intermediate race 136, a coarse spray is emitted through a circular pattern of coarse holes 36. Of course, more spray patterns: may be provided in the same manner.

A propeller or turbine 140 (FIG. 3A) has upstanding fins 142 which are impinged by a stream or streams of water when the shutter plate 80 diverts water into a race in which the turbine is. This impinging stream of water spins the turbine. Integrally attached to the bottom edges of fins 42, flange 144 extends around approximately three quarters of the circumference of the turbine, leaving an open space 145. At any given time one of the groups of holes 38*a*–38*c* (FIG. 2) is uncovered while the other two groups of these holes are covered.

Thus, as the turbine 140 spins, first open space 145 is over holes 38*a* (FIG. 2) and they are uncovered so that water issues therefrom. Then, holes 38*a* are covered by flange 144 and holes 38*b* are uncovered by open space 145 so that water issues therefrom. Next, the spinning turbine uncovers holes 38*c* and water issues therefrom, while flange 144 covers holes 38*a*, 38*b*. Thereafter, turbine 140 again uncovers holes 38*a*. As a result, the user feels a pulsating stream of water.

In this particular embodiment, the face plate 150, lower housing 126, gasket 118, and diverter plate 90, are secured to the bottom of the shower head by a self tapping screw 152 driven into a boss 154 on the bottom of support plate 98. A plastic cap 156 snaps into a hole in the center of the face plate 150 to decorate and conceal the screw head.

Those who are skilled in the art will readily perceive how to modify the invention. Therefore, the appended claims are to be construed to cover all equivalent structures which fall within the true scope and spirit of the invention.

We claim:

1. A multifunction shower head comprising a plate having a plurality of races formed therein, each of said races having an individually associated pattern of spray holes, a spring biased push button controlled pawl and an associated ratchet wheel cam engaged by said pawl, said ratchet wheel taking one step over a predetermined arc in response to each push of said push button and its associated pawl, a shutter plate coupled to move over a predetermined arcuate distance responsive to each step of said ratchet wheel cam, and means responsive to said movement of said shutter plate for directing water into a selected one of said races.

2. The shower head of claim 1 wherein said ratchet wheel cam has a plurality of teeth surrounding the circumference thereof, said pawl being pivotally attached to said push button and positioned to engage and push a tooth on said ratchet wheel cam, said pawl having a leaf spring associated therewith for pressing said pawl into engagement with said engaged tooth while allowing said pawl to deflect and ratchet over a tooth while said push button returns to a normal position after it is released from a pushed position.

3. The shower head of claim 2 wherein said pawl and leaf spring are a single molded plastic piece part, a bias of said leaf spring being supplied by a memory of said plastic.

4. The shower head of claim 1 wherein said shutter plate is a gear having at least one opening therein for water to flow through, and a driving gear meshing with said shutter plate gear, said driving gear and said ratchet wheel cam being mounted on a common shaft to drive said shutter plate through said arcuate distance responsive to each push button operation.

5. The shower head of claim 4 wherein said shutter plate contains a plurality of holes equally distributed around a circumference thereof in order to balance mechanical forces acting in said shower head.

6. The shower head of claim 1 wherein one of said races includes a pattern of grouped water emitting holes, and a water driven turbine in said one race, said turbine having a flange for sequentially covering and uncovering said groups of water emitting holes whereby a pulsating stream of water is issued from said groups of water emitting holes.

7. The shower head of claim 1 and means comprising a handle extending from said shower head to a coupler for a flexible hose leading to a source of water, said push button being in a location where it can be operated by a thumb of a hand holding said handle.

8. The shower head of claim 1 wherein said shower head has a housing and means comprising a coupler on said housing for connecting said shower head to a plumbing pipe.

9. A shower head comprising an outer housing having an inner housing therein, said inner housing having a guide way formed therein, a spring biased slide mounted in said guide way to move between a normal and an off-normal position, said spring bias urging said slide to said normal position, a pawl pivotally mounted on and moving with said slide toward said off-normal position, a toothed ratchet wheel mounted to be rotated over a predetermined arcuate step responsive to each off-normal movement of said pawl, a shutter means moved over a predetermined step in response to each of said arcuate steps of said ratchet wheel, and means responsive to said shutter means movement for selecting one of a plurality of spray patterns.

10. The shower head of claim 9 and a handle for holding said shower head, a coupler on the end of said handle for attachment to a flexible hose, and a push button for moving said slide toward said off-normal position, said push button being in a location where it may be operated by a thumb of a hand that is holding said handle.

11. The shower head of claim 9 and a gear coupled to rotate with said ratchet wheel, and means driven by said gear for displaying an indication of the selected shower spray pattern.

12. The shower head of claim 9 and turbine means driven by water flowing through said shower head for giving a pulsing spray pattern.

13. A multifunction shower head comprising means for delivering any selected one of a plurality of different water spray patterns, push button controlled pawl and ratchet wheel cam means for selecting between said plurality of spray patterns, and means for enabling said shower head to be held by a single hand, and said push button selection being made by a thumb on said single hand.

14. The shower head of claim 13 and means responsive to said push button operation for displaying an indication of the selected spray pattern.

15. The shower head of claim 14 wherein said indication display means is driven by a gear associated with said ratchet wheel cam means in response to said push button action.

* * * * *